United States Patent [19]

Gasser

[11] Patent Number: 4,809,477

[45] Date of Patent: Mar. 7, 1989

[54] ROOFING LAMINATE FASTENER ASSEMBLY

[75] Inventor: David A. Gasser, Wooster, Ohio

[73] Assignee: G.B.R. Enterprises, Wooster, Ohio

[21] Appl. No.: 58,862

[22] Filed: Jun. 5, 1987

[51] Int. Cl.[4] ..... E04B 5/00; F16B 21/00

[52] U.S. Cl. ..... 52/410; 52/127.1; 411/342; 411/344; 411/397

[58] Field of Search ..... 411/340, 342, 344, 346, 411/402, 403, 384, 397, 910; 52/127.1, 127.5, 127.7, 410, 512, DIG. 1

[56] References Cited

U.S. PATENT DOCUMENTS

| | | | |
|---|---|---|---|
| 3,168,850 | 2/1965 | Tennican | 411/342 |
| 4,074,501 | 2/1978 | Sandquist | 52/410 |
| 4,452,023 | 6/1984 | Stahlberg | 52/410 |

FOREIGN PATENT DOCUMENTS

| | | | |
|---|---|---|---|
| 2345613 | 10/1977 | France | 411/342 |
| 21258 | of 1912 | United Kingdom | 411/346 |

*Primary Examiner*—Neill R. Wilson

*Attorney, Agent, or Firm*—Oldham & Oldham

[57] ABSTRACT

A fastener assembly for connecting lightweight roofing structure laminations is shown. The assembly comprises a toggle bolt with an unremovable toggle nut on the lower end of the toggle bolt stem, securing the lower surface of the lamination, and a flanged cap nut threaded on the toggle stem's upper end which secures the lamination's upper surface. The flange cap nut is fitted with a recess complementary to, and adapted to receive a keeper nut fitted with a recess which allows torquing of the flanged cap nut. The keeper nut is also adapted to connect with the top end of the toggle bolt stem in a way, that locks the flanged cap nut and toggle stem together so that the same are incapable of independent rotation, thus preventing the loosening of the fastener assembly.

11 Claims, 2 Drawing Sheets

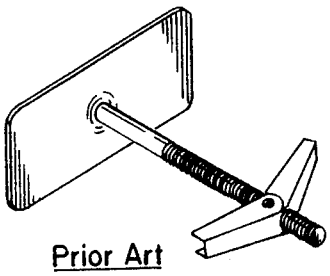
FIG.-1
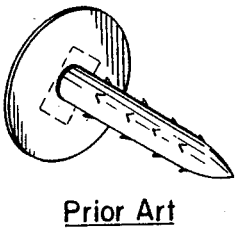
FIG.-1A
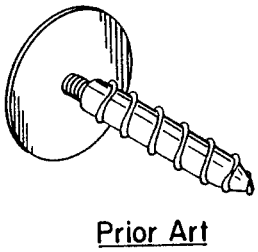
FIG.-1B
FIG.-2A
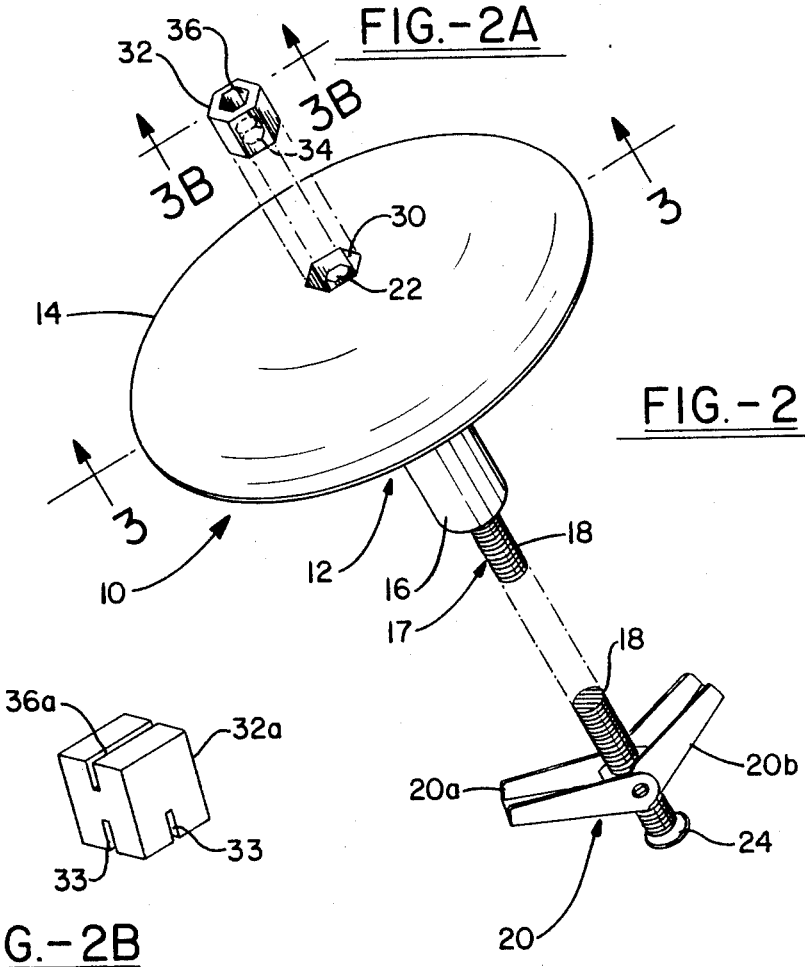
FIG.-2
FIG.-2B

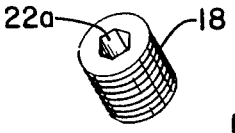
FIG.-2C
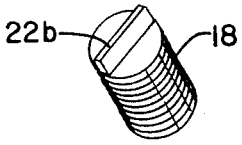
FIG.-2D
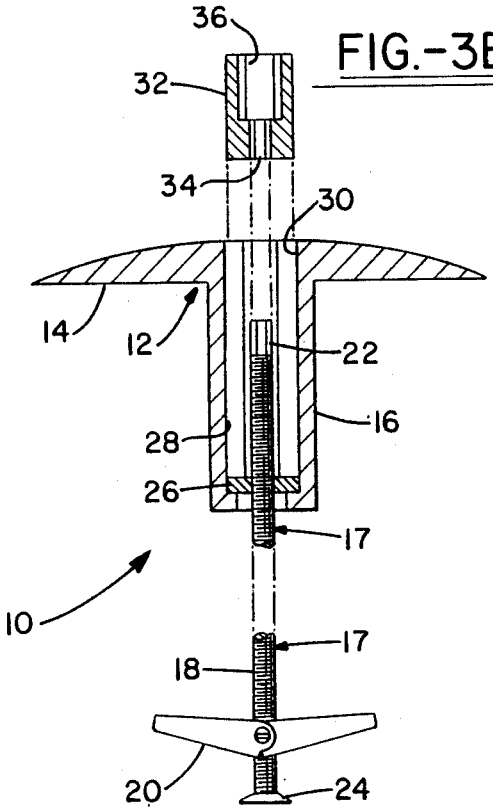
FIG.-3B
FIG.-3
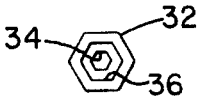
FIG.-3C
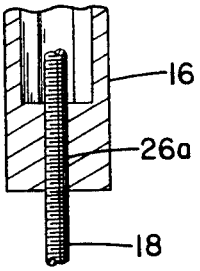
FIG.-3A
FIG.-4
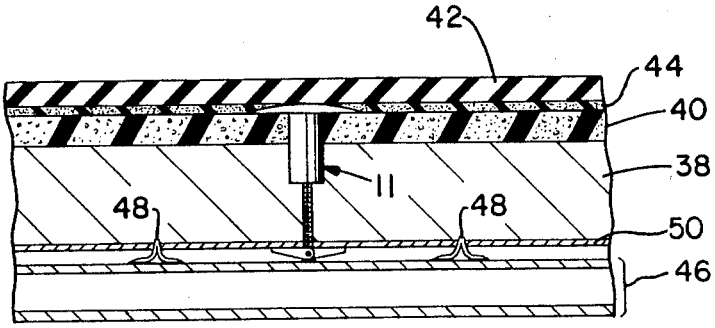

ROOFING LAMINATE FASTENER ASSEMBLY

This invention relates to fastener assemblies useful for connecting adjacent laminate layers into unitary laminations. More particularly, this invention relates to fastener assemblies designed for connecting laminate layer components employed in constructing lightweight roofs in such a way as to provide an inseparable roofing structure. Specifically, this invention relates to fastener assemblies useful for connecting insulation to lightweight roofing decks, comprising toggle bolts locked to flanged cap nuts with keeper nuts, thereby preventing the inadvertant backthreading and loosening of the toggle bolts.

BACKGROUND OF THE INVENTION

With the discovery of new synthetic roofing materials, the trend of the roofing industry has been to fabricate roofs, particularly flat, membrane covered roofs, from lightweight, structural components. Such construction produces less expensive roofs, and since the components exhibit relatively high strength per unit of structure weight, the roofs are capable of supporting greater working loads, for example, snow loads, and therefore, have become very popular. Typically, such roofing structures consist of a supporting framework on which is disposed a layer of decking material, and a layer of insulation fastened on top thereof. A weatherproof roofing material, often a synthetic, elastomeric membrane, is then attached to the lamination, completing the roofing structure. Such structures not only protect the interior of the building from the elements, but are relatively inexpensive, light, strong and durable.

Various methods have been proposed for fastening the insulation layer to the decking material, but for a variety of reasons, these have largely been unsatisfactory. It has been found, for instance, that the fasteners commonly employed tend to loosen, allowing the laminate layers forming the roofing structure to separate, ultimately compromising the ability of the roof to protect the building from the elements.

DISCLOSURE OF THE INVENTION

In view of the foregoing, therefore, it is a first aspect of this invention to provide fastener assemblies capable of securely connecting adjacent laminate layers.

A second aspect of this invention is the provision of fastener assemblies that include a positive locking feature capable of inseparably connecting laminate layers together.

An additional aspect of this invention is to provide a fastener assembly that is easily installed with standard tools, and which is well suited to connecting adjacent layers employed in fabricating lightweight roofing structures.

A further aspect of the invention is to furnish a fastener assembly that is inexpensively and easily fabricated.

The preceding and other aspects of the invention are provided by a fastener assembly comprising:

a flanged cap nut;

a keeper nut, and a toggle bolt, wherein said toggle bolt comprises a threaded stem component, and a toggle nut component threaded thereon; and wherein said cap nut is provided with a longitudinal bore hole adapted to receive and threadably connect with said stem component, said cap nut also being provided with a shaped recess in the top thereof having a shape complementary to, and adapted to receive said keeper nut such that when said keeper nut is inserted therein, rotation of said keeper nut independent of said cap nut is prevented; and wherein further, the lower end of said keeper nut is provided with means adapted to engage the top end of said toggle stem to prevent the rotation thereof independent of said keeper nut, while the top end of said keeper nut is fitted with torquing means; and wherein still further, the lower end of said toggle stem component is modified so that the toggle nut threaded thereon cannot be threaded past the lower end of said toggle stem component.

The foregoing and other aspects of the invention are also provided by a roof structure in combination with a fastener assembly, said fastener assembly comprising:

a plastic, flanged cap nut;

a plastic keeper nut, and a toggle bolt, wherein said toggle bolt comprises a threaded stem component and a toggle nut component threaded thereon, and wherein said cap nut is threadably connected to said stem component, and is also provided with a shaped recess in the top thereof complementary to, and adapted to receive said keepernut such that when said keeper nut is inserted therein, rotation of said keeper nut independent of said cap nut is prevented; and wherein further, the lower end of said keeper nut is provided with engagement means adapted to engage the top end of said toggle stem, and to prevent the rotation thereof, while the top end of said keeper nut is fitted with torquing means; and wherein still further, said engagement means comprises a recess and a complementary shaped member adapted to fit into said latter recess, wherein said latter recess is located in the top end of said toggle stem, while said shaped member is located on the lower end of said keeper nut, or where said locations are reversed; and said torquing means comprises a recess, the last two mentioned recesses having hexagonally shaped, horizontal cross-sections; and wherein even further, the lower end of said toggle stem component is modified so that the toggle nut threaded thereon cannot be unthreaded past the lower end of said toggle stem component.

BRIEF DESCRIPTION OF THE DRAWINGS

The invention will be better understood when reference is had to the following drawings in which like numbers refer to like components and wherein:

FIGS. 1, 1A, and 1B are isometric views of prior art devices.

FIG. 2 is an isometric view of a cap nut/toggle bolt fastener of the invention.

FIG. 2A is an isometric view of one embodiment of a keeper nut of the invention, useful with the fastener of FIG. 2.

FIG. 2B is an isometric view of a further embodiment of a keeper nut.

FIG. 2C is an isometric view of another embodiment of the top end of a toggle stem.

FIG. 2D is an isometric view of still another embodiment of the top end of a toggle stem.

FIG. 3 is a cross-section of the fastener of FIG. 2.

FIG. 3A is a partial view of a lower part of another embodiment of the fastener of FIG. 3 showing a section similar to that illustrated in FIG. 3.

FIG. 3B is a cross-section of a keeper nut along line 3B—3B of FIG. 2A.

FIG. 3C is a top view of the keeper nut of FIG. 2A.

FIG. 4 is a cross-sectional view of a roofing structure employing a complete fastener assembly of the invention.

BEST MODE FOR CARRYING OUT THE INVENTION

FIG. 1, 1A, and 1B are isometric views of various prior art devices intended to accomplish the same result as the fastener assembly of the invention.

FIG. 1 shows a toggle bolt assembly consisting of a toggle bolt loosely attached to a flange. To use the device, a hole is first drilled through the layers making up the roof structure lamination; the toggle bolt is inserted therethrough, and the stem of the toggle bolt is rotated until the roofing structure is held tightly between the flange and the wing-like toggle nut.

FIG. 1A consists of a curved, flat, nail-like device with barbed protrusions, the open ends of which are directed toward the attached flange. The device is designed to be driven down through the various layers of the roof lamination. Once in place, the barbed protrusions are intended to anchor the device firmly in the layers of the lamination, holding them together. FIG. 1B shows a similar device in which, however, a screw-like helix stem is wound down into the layers of the roof structure, anchoring them to each other.

Unfortunately, a roof is not an immobile, stationary structure, but is frequently subjected to forces tending to pull the laminate layers apart. Such forces include gravity, thermal expansion, wind forces, and a variety of other mechanical stresses, the cumulative effect of which tends to delaminate the structure. Such forces gradually cause devices such as those shown in FIGS. 1, 1A and FIG. 1B to pull loose from the roofing structure, particularly since the materials from which the layers are formed are low-density, lightweight compositions. In the case of the device of FIG. 1, the forces at work on the roof tend to cause its toggle nut to gradually unthread to the point at which the nut becomes completely disengaged from the toggle stem to which it is attached.

FIG. 2 shows an isometric view of a fastener of the invention, indicated generally by the numeral 10, comprising a flanged cap nut, shown generally by the numeral 12, attached to a toggle stem 18. The top end of the toggle stem 18 is threaded into the barrel 16 of the flanged cap nut, while the lower end of the toggle stem has a toggle nut, generally 20, threadably disposed thereon, while its terminal threads are rendered inoperative by flaring 24. The top end of toggle stem 18 terminates in a toggle stem head, in the case of the Figure, taking the form of a six-sided "allen" head shape 22, extending into a flange torquing recess 30, disposed in flange 14.

To install the fastener 10, the toggle stem 18 is partially unthreaded from the flanged cap nut 12 until the combined, overall length of such two components is at least as long as the thickness of the combined layers of the lamination, to be secured. A hole is then drilled, punched, or otherwise formed in the lamination having a diameter sufficient to accomodate the diameter of barrel 16 and toggle nut 20, when the latter is in its collapsed configuration, i.e., with wings 20(*a*) and 20(*b*) folded alongside toggle stem 18. The fastener 10 is then inserted into the hole to the point at which wings 20(*a*) and 20(*b*) extend below the lowest layer of the lamination and are free to deploy in their extended position, as shown in the Figure. An allen wrench is thereupon inserted in the flange torquing recess 30 and the cap nut is tightened on toggle stem 18 until the layers of the lamination are drawn tightly together, toggle nut 20 being retained on toggle stem 18 by the flaring 24, as aforesaid. While the retention of toggle nut 20 may be accomplished by the flaring described, it can also be achieved by "wiping" the threads from the end of the toggle stem, or by welding an enlarged stem piece thereto. Once tightened, the fastener is in condition for "locking" to form the fastener assembly, as described in connection with FIG. 2A.

FIG. 2A is an isometric view of one embodiment of a keeper nut 32 of the invention. The keeper nut shown in the Figure includes a toggle head engagement socket 34, and a keeper nut torquing socket 36. When the fastener has been tightened as described in connection with FIG. 2, above, the keeper nut 32 is inserted into flange torquing recess 30, an allen wrench is inserted into the keeper nut torquing socket 36, and the keeper nut and flanged cap nut turned as a unit until the toggle head engagement socket 34 is aligned in a fitting relationship with the correspondingly shaped toggle stem head 22. At this point, downward pressure is exerted on keeper nut 32, forcing the toggle head engagement socket 34 into a fitting relationship around toggle stem head 22, forming the completed fastener assembly of the invention. Thus completed, the keeper nut 32, flanged cap nut 12, and toggle stem 18 can only be rotated as an integrated unit, thus a positive locking action is achieved, and disassembly of the components becomes impossible.

FIG. 2B is an isometric view of a further embodiment of a keeper nut 32*a*, possessing a square, horizontal cross-section with a torquing slot 36*a* disposed in the top thereof, and with toggle head engagement slots 33 located in the bottom of the keeper nut. The external shape of the keeper nuts may vary so long as the shape provided prevents the rotation of the keeper nut independent of the flanged cap nut 12, when the keeper nut is inserted into the flanged torquing recess 30. In other woreds, at least two points on the external perimeter of the keeper nut must have different rotational radii with respect to the center of the keeper nut, the flange torquing recess having a corresponding perimeter.

Likewise, the shape of the toggle head engagement socket may be varied, it only being necessary that the toggle stem head have a counterpart shape.

FIG. 2C shows an isometric view of another embodiment of the top end of toggle stem 18 in which a six-sided, allen-type toggle stem head socket is disposed. When the top end of the toggle stem 18 is thus fastened, the keeper nut will have a correspondingly shaped male portion extending from the lower end thereof, adapted to fit into said recess.

FIG. 2D shows an isometric view of still another embodiment of a toggle stem head 22*b* at the top end of toggle stem 18. The toggle stem head 22*b* is formed in the shape of a blade adapted to fit the toggle head engagement slots 33 of FIG. 2B. The toggle head engagement slots 33 are at right angles to each other in order to reduce the amount of rotation required to reach the point at which the keeper nut is able to engage the toggle stem head blade 22*b*. While different shaped toggle stem heads are possible, as exemplified, the use of those with an allen shape is particularly preferred, since among other advantages, less rotation of the keeper nut is required to arrive at a point of engagement with the toggle stem head. Similarly, although different shapes of keeper nut torquing sockets may be employed, the use of allen shaped sockets is especially desirable, for example, since it facilitates the use of standard allen wrenches in torquing the fastener 12.

While the flanged cap nut 12, and the keeper nut 32 may be formed from a variety of materials including, for instance, metals or plastics, the use of plastics is of advantage since plastic materials are generally inexpensive, easily fabricated, for example, by injection molding, and are not susceptible to corrosion. In fabricating the fastener assemblies of the invention, the use of nylon for such components is preferred.

While toggle stem 18 will usually be made of metal, as will toggle nut 20, the toggle stem can also be made from plastic, if desired.

FIG. 3 is a cross-section of the fastener of FIG. 2 along line 3—3 of FIG. 2, showing the flanged cap nut 12, comprising barrel 16 and flange 14. In the Figure, the flanged cap nut 12 has a longitudinal bore hole 28 disposed therein, the top end of which forms a hexagonally shaped, flange torquing recess 30, adapted to fit a similarly shaped keeper nut 32. FIG. 3 presupposes fabrication of the flanged cap nut 12 from plastic. The barrel 16 shown in the Figure is formed about a metal retainer nut 26 which provides threads to engage threaded toggle stem 18 of the toggle bolt, shown generally by the numeral 17. In addition to the threaded toggle stem 18, toggle bolt 17 includes toggle nut 20, prevented from unthreading past the lower end of the toggle stem by flare 24, and a toggle stem head 22, having a six-sided, allen-type shape.

The length of barrel 16 is determined by the type and number of threads required to properly engage toggle stem 18. Furthermore, the barrel length must be selected so that such length, together with the length of the toggle stem 18 above toggle nut 20 is long enough to accomodate the layers of roofing structure to be fastened. Within such considerations, however, a barrel length of from about 2 to 4 inches is commonly provided, with a length of about 3 inches being usually preferred. The diameter of the barrel freuqently ranges from about ⅜ inch to 1¼ inches, about ¾ inch being typical. Governing factors include the strength required, as well as the diameter of the longitudinal bore hole 28, which latter must be adequate to accomodate toggle stem 18. Flange 14 is usually round, like barrel 16, but if desired, may have a different shape. Flange 14 is usually slightly rounded, as shown in the Figure, to avoid "cupping", i.e., deformation of the outer edges in an upward direction, due to tension applied to the fastener 10, but it may be formed in other shapes, particularly when it is fitted with ribs extending radially from its center for reinforcing purposes. Commonly, the flange is from about 2 to 4 inches in diameter, with a diameter of about 3 inches being standard. The depth of the flange torquing recess will preferably be selected so that the keepernut inserted therein will not extend over the top surface of the flange 14. The diameter of the toggle stem 18 will generally be from about 3/16 inch to 5/16 inch. It is desirable that the various components of the fastener 10 including the materials of construction, dimensions, threaded areas and the like be designed to withstand a tensile strength of at least about 500 lbs in their assembled configuration, since a fastener assembly exhibiting that strength is currently required to meet the "wind uplift" roofing specification set by the Factory Mutual Insurance Company. Considerations involved in providing such strengths, in the context of the invention disclosed herein, are well known to those skilled in the art.

FIG. 3A is a partial view of a lower part of another fastener embodiment along a section similar to that shown in FIG. 3. The Figure shows a toggle stem 18 passing through the lower end of a barrel 16, being engaged therewith by retaining threads 26*a*. The structure shown in the Figure provides another alternative to the threads furnished by retainer nut 26 in FIG. 3.

FIG. 3B is a cross-section of a keeper nut along line 3B—3B of FIG. 2A. The Figure shows details of the hexagonal shape of keeper nut torquing socket 36, and toggle head engagement socket 34. The dimensions of the recesses will be chosen to satisfactorily resist the torquing stresses applied thereto, and to match their mating counterpart components.

FIG. 3C is a top view of the keeper nut of FIG. 2 showing the hexagonal shapes of the outside of keeper nut 32, keeper nut torquing socket 36, and toggle head engagement socket 34. While the Figure shows uniformly hexagonal shapes, such shapes may be varied. For example, the outside of keeper nut 32 could be square, while keeper nut torquing socket 36 might be hexagonal, and the toggle head engagement socket could be slotted. Other combinations will occur to the practioner.

FIG. 4 is a cross-sectional view of a roofing structure employing a fastener assembly of the invention.

The Figure shows a fastener assembly 11 holding together laminate layers of a roofing structure including an insulation layer 40, a roof deck layer 38, and a panel 50. The roofing structure is covered with a roofing membrane 42 secured to the roofing structure by means of a layer of adhesive mastic 44. The roofing structure, including the attached roofing membrane 42, is supported on "bulb tees" 48, the latter members themselves being supported by joists 46.

The insulation, which may be made from fiberglass, wood fiber, foamed polystyrene or polyurethane, or similar materials, may be of any thickness desired. Normally, however, it will range in thickness from about ½ inch to 8 inches. The roof deck material 38 is generally made from materials such as gypsum; "Tectum", the trademark for a material comprising wood fibers bound with a binder produced by Tectum, Inc., or similar materials. Roof deck 38 may either by of poured construction, or in slab form. When the roof deck 38 is poured, it will be necessary to provide the roofing structure with panels 50, which may be fabricated from a variety of materials including such things as hard board or asbestos, etc. The thickness of the roof deck 38 may also be varied, as desired; generally, however, it will be from about 2 inches to 4 inches. The panel 50 will usually be about ¼ inch to ⅜ inch thick, although the thickness may vary from such range, depending upon load considerations. The bulb tees 48 are metal structural members positioned at right angles to the joist 46 which provide support as previously described. While the Figure shows the use of an adhesive 44 to secure roofing membrane 42 to the roofing structure, other methods of fastening the roofing membrane, which may be formed from any of the elastomers normally employed for roofing use including EPDM, butyl, and others, may be used, for example mechanical fastening devices of the type known to the industry.

While in accordance with the patent statutes, a preferred embodiment and best mode has been presented, the scope of the invention is not limited thereto, but rather is measured by the scope of the attached claims.

What is claimed is:

1. A fastener assembly comprising:

a flanged cap nut;

a keeper nut, and a toggle bolt, wherein said toggle bolt comprises a threaded stem component, and a toggle nut component threaded thereon; and wherein said cap nut is provided with a longitudinal bore hole adapted to receive and threadably connect with said stem component, said cap nut also being provided with a shaped recess in the top thereof having a shape complementary to, and adapted to receive said keeper nut such that when said keeper nut is inserted therein, rotation of said keeper nut independent of said cap nut is prevented; and wherein further, the lower end of said keeper nut is provided with means adapted to engage the top end of said toggle stem and to prevent the rotation thereof independent of said keeper nut, while the top end of said keeper nut is fitted with torquing means; and wherein still further the lower end of said toggle stem component is modified so that the toggle nut threaded thereon cannot be threaded past the lower end of said toggle stem component.

2. A roof structure in which insulation is fastened onto a roof deck by means of a fastener assembly according to claim 1.

3. A fastener assembly according to claim 1 wherein the engagement means and torquing means, respectively, comprise recesses having hexagonally shaped horizontal cross-sections, and the top end of said toggle stem has a hexagonal shape complementary, to and designed to fit into the recess of said engagement means.

4. A fastener assembly according to claim 3 in which, however, the recess of the engagement means is located in the top end of said toggle stem, while the lower end of the keeper nut is fitted with a hexagonal shape thereon complementary to the shape of a recess in the top end of said toggle stem, and designed to fit therein.

5. A fastener assembly according to claim 1 in which the threadable connection between said threaded stem component and the cap nut is provided by means of threads located in at least a portion of said bore hole, in contact with the threads of said stem component.

6. A fastener assembly according to claim 5 in which said cap nut is fabricated from plastic.

7. A fastener assembly according to claim 6 in which the threads located in said bore hole are provided by a threaded retainer nut incorporated in said cap nut.

8. A fastener assembly according to claim 1 in which the engagement means comprises the interconnection between a blade component and complimentary slot component, said blade component being attached to the top end of the toggle stem, and the complimentary slot component being recessed in the lower end of said keeper nut, or wherein the blade component is attached to the lower end of the keeper nut, and the complimentary slot component is recessed in the top end of the toggle stem.

9. A fastener assembly according to claim 1 in which said torquing means comprises a slot recessed in the top of said keeper nut adapted to receive a complementary blade member.

10. A fastener assembly according to claim 1 in which said keeper nut either has a hexagonal or a square horizontal cross-section.

11. A roof structure in which insulation is fastened onto a roof deck by means of a fastener assembly comprising:

a plastic, flange cap nut;

a plastic keeper nut, and a toggle bolt, wherein said toggle bolt comprises a threaded stem component and a toggle nut component threaded thereon; and wherein said cap nut is threadably connected to said stem component, and is also provided with a shaped recess in the top thereof, complimentary to, and adapted to receive said keeper nut such that when said keeper nut is inserted therein, rotation of said keeper nut independent of said cap nut is prevented; and wherein further, the lower end of said keeper nut is provided with engagement means adapted to engage the top end of said toggle stem, and to prevent the rotation thereof, while the top end of said keeper nut is fitted with torquing means; and wherein still further, said engagement means comprises a recess and a complimentary shaped member adapted to fit into said latter recess, wherein said latter recess is located in the top end of said toggle stem, while said shaped member is located on the lower end of said keeper nut, or where said latter recess is located in the lower end of said keeper nut, while said shaped member is located on the top end of said toggle stem; and said torquing means comprises a recess, the last two mentioned recesses having hexagonally shaped, horizontal cross-sections; and wherein even further, the lower end of toggle stem component is modified so that the toggle nut threaded thereon cannot be unthreaded past the lower end of said toggle stem component.

* * * * *